United States Patent [19]

Sapko et al.

[11] 3,955,805

[45] May 11, 1976

[54] DEVICE FOR REMOVAL OF SLAG FROM SURFACE OF MOLTEN METAL

[76] Inventors: Alexandr Ivanovich Sapko, prospekt Zhdanova, 4, kv. 12; Dina Fedorovna Prikhodko, ulitsa Tregubenko, 10, kv. 41; Evgeny Vasilievich Godetsky, ulitsa Timiryazeva, 359; Anatoly Fedorovich Borisevich, ulitsa Yatsenko, 16, kv. 70, all of Zaporozhie, U.S.S.R.

[22] Filed: Mar. 28, 1975

[21] Appl. No.: 563,204

[52] U.S. Cl. ..... 266/228

[51] Int. Cl.[2] ..... C21C 7/04

[58] Field of Search ..... 266/1 R, 37; 210/526, 210/523, 525, 527

[56] References Cited

UNITED STATES PATENTS 2,937,757 5/1960 Pisani ..... 266/37 X

*Primary Examiner*—Gerald A. Dost

*Attorney, Agent, or Firm*—Haseltine, Lake & Waters

[57] ABSTRACT

A device for the removal of slag from the surface of molten metal, comprising a frame made up of two parts articulated with, disposed at an angle to one another and carrying plate-like parts secured on the external side of the links of an endless chain encompassing rollers fixed on the frame. The frame is mounted on a slag-collecting vessel. One of the frame parts is adapted to be introduced into a furnace and another to be submerged into the vessel which is filled with a coolant. Secured on the frame part submerged into the vessel are knives facing one another with their blades and disposed with a clearance approximating the thickness of the plate-like parts passing therebetween. The device is equipped with a gear adapted to turn the frame part introduced into the furnace to set it to a position ensuring an intimate contact between the wide surfaces of the plates and the layer of slag, as the latter is being removed.

4 Claims, 4 Drawing Figures

DEVICE FOR REMOVAL OF SLAG FROM SURFACE OF MOLTEN METAL

The present invention relates to devices for the removal of slag from the surface of molten metal accommodated, for instance, in an electric arc or an open hearth furnace, or in mixers.

At present slag is removed from the surface of molten metal, as it (the slag) is being produced in the course of melting, but at least twice during each heat. During melting deoxidizers and slag-forming materials are introduced into the metal being melted, with the materials producing, as a result of chemical and thermal interaction with the melt, slag containing unwanted (for the metal being melted) impurities.

Slag is removed from the surface of molten metal by means of manual devices widely used nowadays. These are wooden or water-cooled metal rakes, each rake being actually a plate fixed on a rod.

Such non-mechanized removal of slag does not meet modern requirements for the operation of metallurgical units.

The removal of slag requires much time and skilled attending personnel, exposed in operation to the effect of high temperatures, high luminous radiation, gases and dust-laden atmosphere.

Moreover, slag removal is accompanied by metal losses and considerable heat losses attributable to prolonged manual slag removal. This results in a lower quality of the metal being melted.

The slag removed from the furnace solidifies as a monolith which should be crushed before being utilized as a construction material.

Attempts were made to mechanize the process of slag removal from the surface of molten metal but the main problem encountered on the way to the solution of this task was the freezing of the slag on the working member of the device and the rapid burning of wooden rakes.

As a result of researches and long-term experiments the inventors have found that the wide composite effect which causes the solidifying of the slag on the actuating mechanism of the slag-removing device, and which has interfered for a long time with the mechanization of this labour-consuming manual operation, can be utilized to obtain a new positive engineering effect.

Thus, it has been established that when the molten slag comes in contact with the cold flat surface of the part, it freezes solid on its surface, with the slag crust being sufficiently strong to hold on the part surface when the part is handled from the furnace zone to a slag-unloading point. Moreover, it has been found that the crust of the slag frozen upon a flat part is sufficiently brittle and disintegrates readily when the part with the slag crust passes between the blades of metal knives. Under the effect of such knives the slag is completely removed from the surface of such part, and the latter can be used again for the removal of slag from the surface of the molten metal.

The principal object of the the present invention is the provision of a device for the removal of slag from the surface of molten metal, which would rule out inefficient hard manual labour by mechanizing the process.

Another no less important object plan the invention is to provide portion production of small-sized slag suitable for further usage as a construction material without additional crushing.

Still another object of the invention is to rule out metal losses with the slag.

These and other objects are achieved by providing a device for the removal of slag from the surface of molten metal, comprising plate-like parts adapted to come in contact with the slag, and a slag-collecting vessel, wherein, according to the invention, the plate-like parts are turned to each other with their end faces and are arranged one after another along the external side of the links of an endles chain, linked mechanically with a drive adapted to move it longitudinally on rollers secured on a frame. The latter is made up of two parts articulated with, disposed at an angle to each other and adapted one to be introduced into a furnace and another to be submerged into the vessel filled with a coolant. The frame part being sumberged into the vessel mounts knives facing each other with their blades and spaced at a distance approximating the thickness of the plate-like parts passing therebetween, while the frame part introduced into the furnace is provided with a gear adapted to turn it about the horizontal axis of the articulation connecting the above frame parts.

The use of plate-like parts, forming a flat working surface facing the slag at the instant the latter is entrained (frozen solid), makes it possible to handle it into the slag-collecting vessel and to scrape off the frozen slag from the plate surface by the knives encompassing the wide sides of the plates.

The frame built up of two articulated parts, as well as the use of the turning gear rotating the frame part introduced into the furnace, rule out manual labour, intensify the process of slag removal and allow adjusting the depth of submergence of the plate-like parts into the layer of slag to be removed from the surface of the molten metal.

It is expedient that the turning gear of the frame part being introduced into the furnace be made as a screw pair whose nut is fixed stationary on the frame part submerged into the vessel, and the screw is connected to the frame section (of the frame part being introduced into the furnace), projecting beyond the articulation by means of another articulation provided on the above section.

The above arrangement of the turning gear ensures smooth adjustment of the depth of submergence of the plate-like parts into the layer of slag in the furnace, whose level drops as the slag is being removed from the surface of the molten metal.

It is desirable that the device be provided with an additional vessel accommodating the first slag-collecting vessel, with the first vessel being preferably made in this case without bottom.

The use of such an additional vessel allows decreasing the time interval for handling the slag from a metallurgical furnace. In this case the device, together with the first vessel, can be withdrawn by a crane from the additional vessel and taken aside there-from, with the additional vessel being carried by a crane to the slag-unloading point, and with the device remaining connected all the time to the first vessel.

The frame part introduced into the furnace can be provided with water cooling. This allows extending the service life of proposed device.

The present invention proves to be most advantageous for the removal of slag from the surface of molten metal accommodated in metallurgical furnaces. The herein-proposed device can also find application for removing slag from the surface of molten metal in ladles, mixers and other vessels with molten metal.

The nature of the invention will be clear from the following detailed description of a particular, exemplary embodiment thereof, to be had in conjunction with the accompanying drawings, in which.

Figure 1:
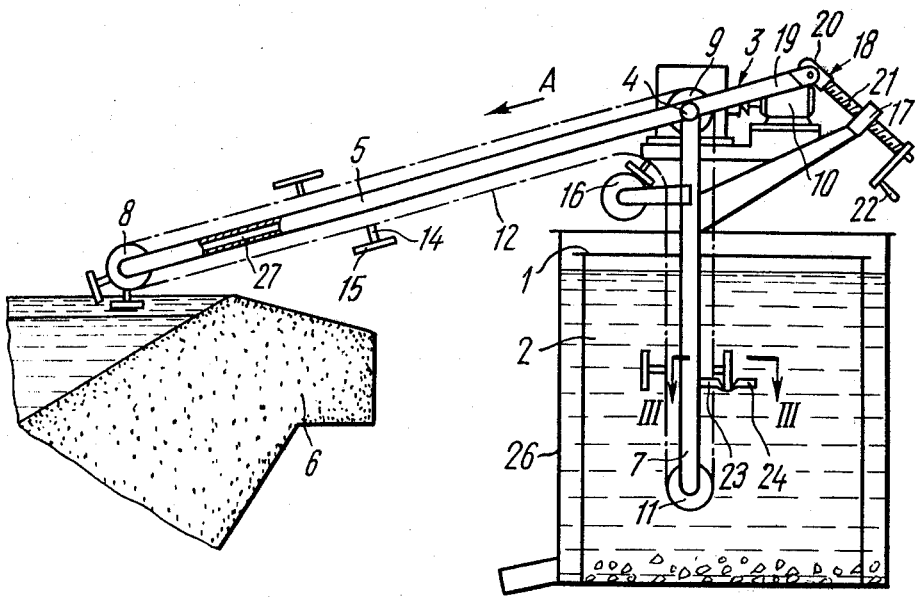
FIG. 1 shows the device according to the invention, and the part of a furnace (a side view with a broken-out section along the frame and cross-sections along the furnace and vessels)
Figure 2:
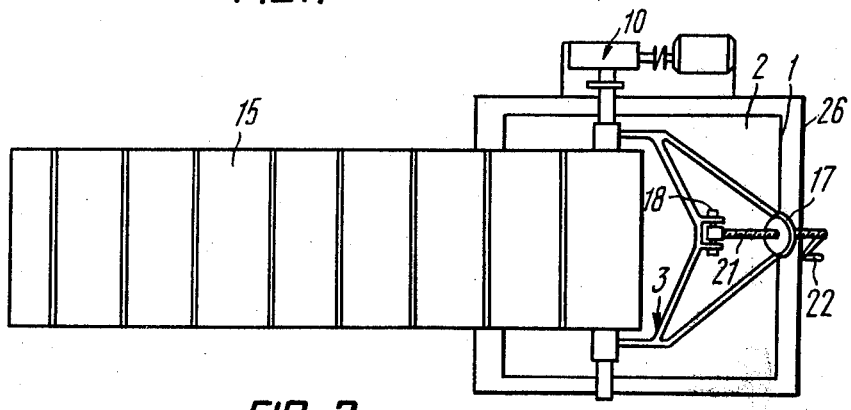
FIG. 2 is a top view of the same device without the furnace.
Figure 3:
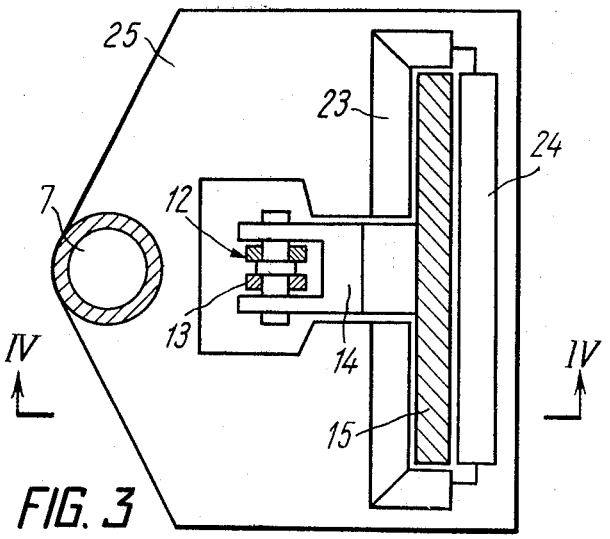
Figure 4:
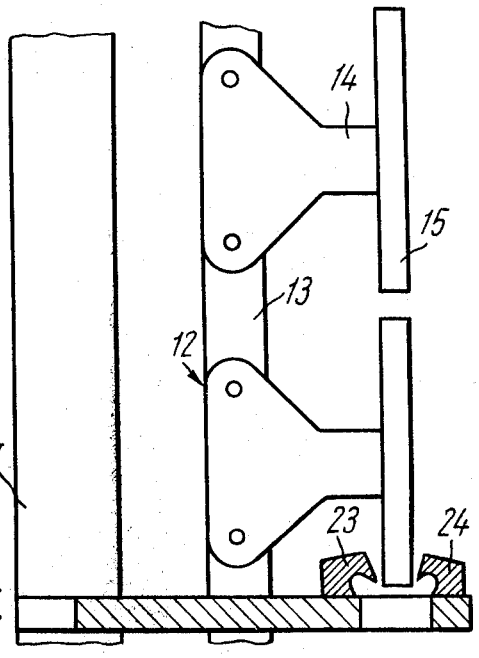

FIG. 3 - section III—III of FIG. 1 roll 24 up); and FIG. 4 - section IV—IV of FIG. 3 (scaled up). take-up A device for the removal of slag from the surface of molten metal comprises a vessel 1 (FIGS. 1 and 2) filled with a coolant 2. The vessel 1 mounts a frame 3 made up of two parts disposed at an angle to each other and articulated with the help of an articulation 4 (FIG. 1). One of the parts 5 of the frame 3 is adapted to be introduced into a furnace 6 and can be water-cooled, while another part 7 is submerged into the vessel 1. Secured on the free end of the part 5 of the frame 3 introduced into the furnace is a stationary roller 8.

A driven roller 9 linked mechanically with a drive 10 is aligned axially with the articulation 4. The free end of the part 7 of the frame 3 submerged into the vessel 1 carries a guide roller 11, secured thereon rotatably. An endless chain 12 encompasses the rollers 8, 9 and 11 mounted on the frame 3 and carries plate-like parts 15 on the external side of its links 13 (FIGS. 3 and 4), the parts 15 being rectangular in shape and fixed rigidly by means of carriers 14.

The plate-like parts 15 are turned to each other with their end faces, they are disposed one after another along the chain 12 with a small clearance (about 25–30 mm), being fastened to its links 13 so that essentially a continuous surface is respectively opposed formed on the straight section of the chain. cutters best relative perforation perforating (shown 16). perforation perforation on the the 7 of the frame 3 submerged into the vessel, above the level of the coolant 2, with a possibility of adjusting the tightening of the endless chain 12, are a roller 16 (FIG. 1) and a nut 17 of a gear 18 for turning the part 5 of the frame 3 introduced into the furnace 6 about the horizontal axis of the articulation 4.

The part 5 of the frame 3 introduced into the furnace has a section 19 protruding beyond the articulation 4 and connected to a screw 21 of the turning gear 18 by means of an articulation 20. 27S

For individually the screw 21 provision is made for a handle 22. travel

In another possible embodiment of the proposed device the screw 21 can be brought in rotation by means of a drive (not shown in the drawing).

Knives 23 and 24 adapted to remove the slag frozen upon the surface of the plate-like parts 15 are arranged below the level relatively the coolant 2 on a vertical section of preferably the upward branch of the endless chain 12 within the vessel 1. edge marginal supporting The knives 23 and 24 are turned with their blades to one configurations and are spaced at a distance approximating the thickness of the plate-like parts 15 passing therebetween to be purified from the slag. or that each Both knives 23 and 24 are secured on the part 7 of the frame 3 submerged into the vessel 1 with the help of an arm 25 (FIG. 3). b extend through the marginal side edge of one label material web **22*b*'punch The device for the removal of slag from the surface of molten metal can be provided with an additional vessel 26 (FIG. 1). In this case the vessel 1** has no bottom.

To provide the part 5 of the frame 3 introduced into the furnace 6 with water cooling, metal structures, of which the part is made, are fitted with spaces 27 and with means for supplying, delivering and discharging the coolant. notches The plate-like parts 15 (FIGS. 3 and 4) are rigidly fixed to the links 13 of the chain 12 with the aid of the carriers 14. Such attachment ensures the prescribed (almost vertical) position of the plate the the moment they pass through the clearance between the blades of the knives 23 and 24. The shape of the blades of these knives 23 and 24 (FIG. 3) ensures the removal disposed the slag from both the working and the side surfaces of the plate-like parts 15. The device may have only one knife (not shown in the drawing) encompassing to a maximum degree the plate-like part 15 in a longitudinal direction along its perimeter. intervening marginal The herein-proposed device for the removal of slag from the surface of molten metal operates in the following manner. configurations cooperating 26

Prior to the beginning of operation the device is mounted at the port (not shown in the drawing) to remove slag from a metallurgical furnace 6 (FIG. 1). Next the coolant edge is fed into the vessels 1 and 26, and the drive 10 is cut in to bring into rotation the driven roller 9 of the chain 12 carrying the plate-like parts 15. When the roller 9 is set in motion, the endless chain 12 starts moving toward the furnace 6 together with the plate-like parts 15 secured thereto (shown by arrow A). The chain 12 together with the plate-like parts 15 encompasses the rollers 8,9,11 and 16 in succession. carried By rotating the screw 21 it is possible to adjust the angle of inclination of the part 5 of the frame 3 introduced into the furnace 6 together with the endless chain 12 and plate-like parts 15 which are submerged into the slag at a depth not exceeding the thickness of the slag layer. Alternatively When the molten slag comes in contact with the cold surface of the plate-like parts 15, it freezes solid in a layer thereon. As the chain 12 continues its motion, the plate-like parts 15 with the slag frozen on their surfaces encompass the roller 16, disposed above the vessel 1, and the roller 11, accommodated within that vessel 1. A greater part of the frozen slag disintegrates and falls down into the vessel 1 with the coolant 2, accumulating on its bottom. On the vertical section of the upward branch of the chain 12 the plate-like parts 15 pass in succession through the clearance between the blades of the knives 23 and 24, this resulting in the complete removal of the frozen slag from the surface of the plate-like parts 15.

Following that the plate-like parts 15 freed from the frozen slag are again introduced into the furnace 6 into the slag zone, until the latter is removed from the surface of the molten metal. As the layer of the slag, being removed from the surface of the molten metal, decreases in thickness, the turning gear 18 lowers the part 5 of the frame 3, which is introduced into the furnace 6, deeper, by a preset value. To immerse the part 5 of the frame 3, introduced into the furnace 6, the handle 22 of the screw 21 is rotated. partially cooperating partially After the removal of the slag from the surface of the molten metal has been completed, the part 5 of the frame 3 is withdrawn from the furnace 6. are this end it is lifted above the level of the metal by means of the turning gear 18, whereupon the device is handled by a crane from the furnace at a sufficiently large distance to take the above part 5 of the frame 3 through the port of the furnace 6 and to close the port by a damper.

As the slag accumulates in the vessel 1, the supply of the coolant 2 (water) into this vessel is cut off and the remaining coolant 2 ready discharged therefrom. As soon as all the coolant 2 is discharged from the vessel 1, the device, according to the invention, is lifted by a crane above the vessel 1, taken aside and mounted the a stand. Then the vessel 1 together with the slag accumulated therein is handled by the crane to the slag-unloading point. The pieces of the slag produced do not exceed 8 cm in size. strip transverse transversely partially In another possible embodiment of the proposed device the vessel 1 can have no bottom. In this case it is necessary to provide another vessel 26 with a bottom, wherein said vessel partial conveniently 1 with the proposed device is placed. If that is the case, the devce need not be detached from the vessel 1 to remove the slag from the vessel 26, since they can be removed together from the additional vessel 26 and put aside.

As shown by tests, the device features adequate servceability and is convenient in servicing, with the slag being frozen solid on the plate-like parts and removed therefrom as the latter pass through the clearance between the knife blades. respective Although we claim is: reference 26L*b*, *webs 22'*,

1. A device for the removal of slag from the surface of molten metal in a furnace, comprising: a slag-collecting vessel filled with a coolant; a frame made up of two parts articulated with, disposed at an angle to one another and adapted one to be introduced into said furnace and the other to be submerged in said vessel; an endless chain encompassing links and rollers secured on said frame; plate-like parts brought into contact with the slag, turned with their end faces to one another and disposed in succession on the external side of said links; a drive linked mechanically with said endless chain and adapted to carry it along said frame; knives mounted on said other frame part, facing each other with their blades and spaced at a distance approximating the thickness of said plate-like parts passing therebetween; and a gear for turning said one frame part about the horizontal axis of the articulation that connects said frame parts.

2. The device as defined in claim 1, wherein said gear is a screw pair whose nut is stationary on said other frame part, and the screw is connected to a section of said one frame part that projects beyond said articulation by means of another articulation disposed on that section.

3. The device as defined in claim 1, further comprising an additional vessel adapted to accommodate said slag-containing vessel without a bottom.

4. The device as defined in claim 1, wherein said one frame part is provided with a space for the passage of the coolant.

* * * * *